US007529501B2

(12) United States Patent
Ishii

(10) Patent No.: US 7,529,501 B2
(45) Date of Patent: May 5, 2009

(54) IMAGE FORMING APPARATUS WITH EFFICIENT SPACE UTILIZATION

(75) Inventor: Takeshi Ishii, Osaka (JP)

(73) Assignee: Kyocera Mita Corporation (JP)

( * ) Notice: Subject to any disclaimer, the term of this patent is extended or adjusted under 35 U.S.C. 154(b) by 212 days.

(21) Appl. No.: 11/359,132

(22) Filed: Feb. 21, 2006

(65) Prior Publication Data

US 2006/0204301 A1 Sep. 14, 2006

(30) Foreign Application Priority Data

Feb. 23, 2005 (JP) ..... 2005-046616

(51) Int. Cl.
*G03G 15/00* (2006.01)

(52) U.S. Cl. ..... 399/107; 399/110; 347/108; 347/222; D18/37

(58) Field of Classification Search ..... 399/107, 399/110; 347/108, 222; D18/37
See application file for complete search history.

(56) References Cited

U.S. PATENT DOCUMENTS 5,799,230 A * 8/1998 Lloyd ..... 399/107
6,697,586 B2 * 2/2004 Yamamoto et al. ..... 399/110

FOREIGN PATENT DOCUMENTS

| | | | |
|---|---|---|---|
| JP | 63234267 A | * | 9/1988 |
| JP | 04199157 A | * | 7/1992 |
| JP | 05307337 A | * | 11/1993 |
| JP | 8-240945 | | 9/1996 |
| JP | 2002032822 A | * | 1/2002 |

* cited by examiner

*Primary Examiner*—David M Gray
*Assistant Examiner*—Ryan D Walsh
(74) *Attorney, Agent, or Firm*—Gerald E. Hespos; Anthony J. Casella

(57) ABSTRACT

Disclosed is an image forming apparatus (1) in which a sheet (P) is fed through a conveyance passage from one wall (2*a*) to the other wall (2*b*) of a box-shaped housing (2), and the sheet (P) reversed in a reversing passage (28) near the other wall (2*b*) is discharged in a discharge section of a top wall (2*c*), and the other wall (2*b*) near which the reversing passage (28) is provided includes an upper portion projecting outward in the top wall (2*c*) and a lower portion receding inward in a bottom wall (2*d*) so that an area of the bottom wall (2*d*) is smaller than that of the top wall (2*c*). Therefore, a space for an installation can be reduced when the image forming apparatus (1) is disposed on a desk (40) and the like.

10 Claims, 3 Drawing Sheets

IMAGE FORMING APPARATUS WITH EFFICIENT SPACE UTILIZATION

BACKGROUND OF THE INVENTION

1. Field of the Invention

The present invention relates to an image forming apparatus, such as a printer.

2. Description of the Related Art

Conventionally, there has been known an image forming apparatus in which a toner image on a peripheral surface of a photoconductive drum is transferred and fixed on a sheet during a process of feeding the sheet through a conveyance passage from a front wall (one wall) to a rear wall (the other wall) of a housing of the image forming apparatus, and the sheet reversed in a reversing passage connected to the conveyance passage is discharged in a discharge section in a top wall of the housing of the image forming apparatus, as disclosed in Japanese Unexamined Patent Publication No. Hei. 8-240945.

The housing of the image forming apparatus as above is formed into a box-shape, and the rear wall of the housing near which the reversing passage is provided is generally formed in a vertical direction. Accordingly, it is necessary to dispose the vertical rear wall in such a rearward position as to provide the reversing passage with a space for assuring smooth conveyance.

However, the bottom area of the housing is the same as the top area of the housing. Consequently, in the case of installing the image forming apparatus on a desk and the like, a large space is needed for its installation. Further, the image forming apparatus is often installed in the state that the rear wall of the housing faces a wall of a room. In the case where a plug of an electronic power supply cable or an interface cable, such as a printer cable, is connected to a cable connection port provided in the rear wall, a space for accommodating the plug and the cable is required between the rear wall of the housing and the room wall, which consequently causes the installation to require a larger space. Further, in the case of providing an outflow opening in the rear wall, it is necessary to dispose the image forming apparatus to provide a sufficient distance from the room wall to keep the outflow opening from being blocked off. Accordingly, it also causes the installation to require larger space.

SUMMARY OF THE INVENTION

In view of the above problem, it is an object of the present invention to provide an image forming apparatus which can be installed closer to a wall of a room with a reduced installation area.

In order to solve the problem, according to an aspect of the invention, in an image forming apparatus where a toner image on a peripheral surface of a photoconductive drum is transferred and fixed on a sheet in a process of feeding the sheet through a conveyance passage from one wall to the other wall, and the sheet reversed in a reversing passage connected to the conveyance passage is discharged in a discharge section in a top wall of the image forming apparatus, the other wall near which the reversing passage is provided includes an upper portion projecting outward and a lower portion receding inward.

With this construction, the other wall near which the reversing passage is provided includes the upper portion projecting outward and the lower portion receding inward. Thus, a bottom area of the housing is smaller than a top area of the housing. This can provide a reduced installation space for installation of an image forming apparatus on a desk or the like.

BRIEF DESCRIPTION OF THE DRAWINGS

FIGS. 3A to 3D show the printer, wherein FIG. 3A is an explanatory view showing a rear of the printer, FIG. 3B is a cross sectional view from side showing a cable connection port, FIG. 3C is a cross sectional view from side showing an electrical power switch, and 3D is a cross sectional view from side showing an outflow opening.

DETAILED DESCRIPTION OF THE PREFERRED EMBODIMENTS

Figure 1:
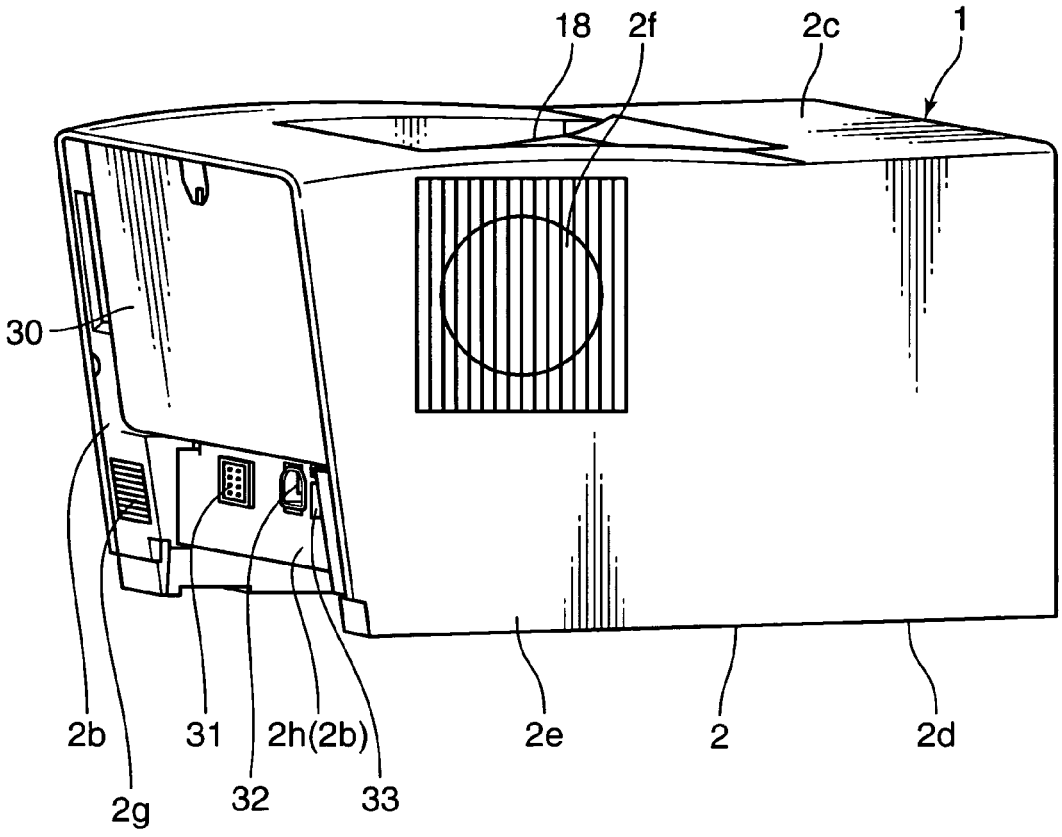
FIG. 1 is a perspective view showing a printer according to an embodiment of the present invention.
Figure 2:
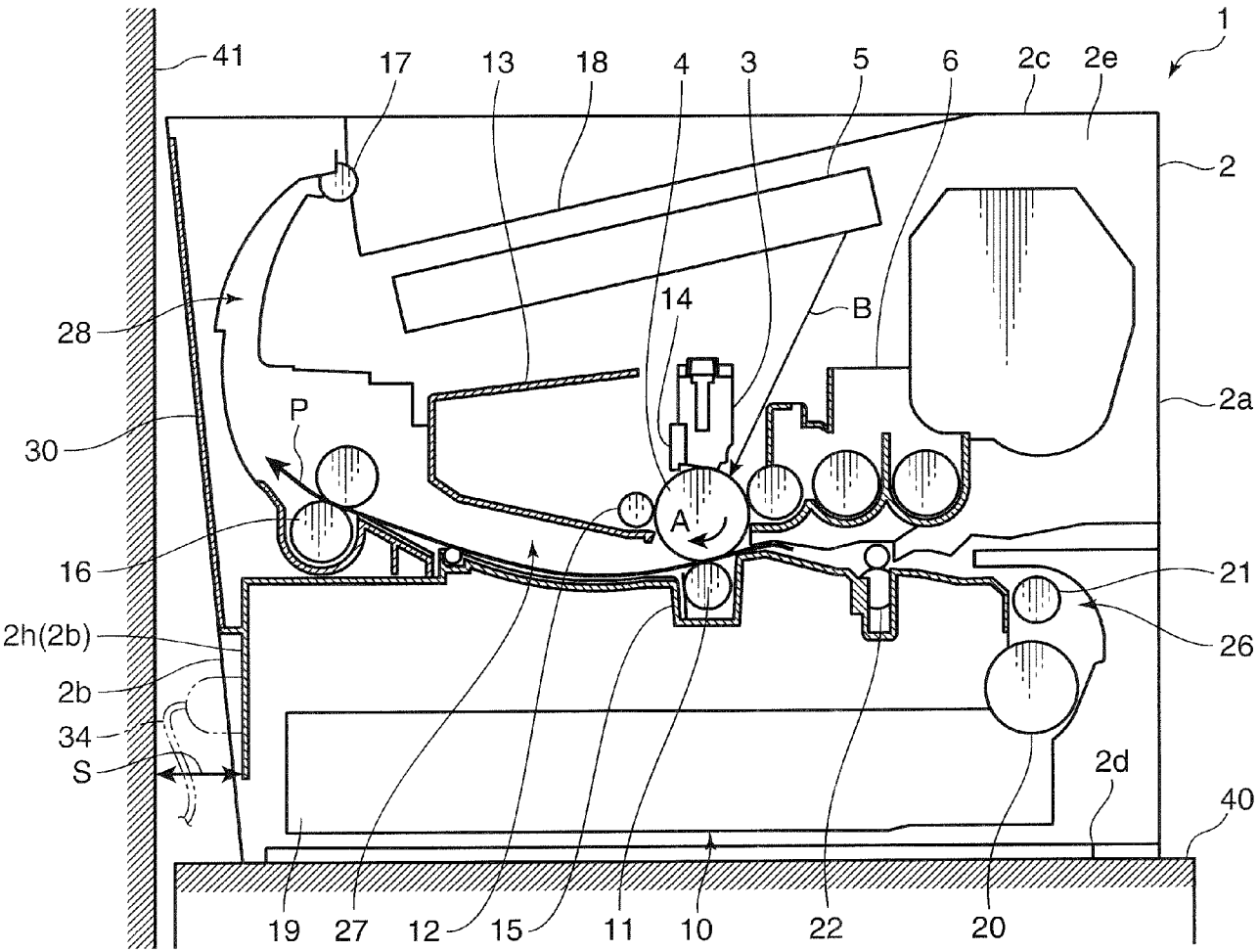
FIG. 2 is a cross sectional view from side showing a schematic configuration of the printer.

FIG. 1 is a perspective view showing a printer according to an embodiment of the present invention, which is an image forming apparatuses. FIG. 2 is a cross sectional view from side, showing a schematic configuration of the printer.

In a box-shaped housing 2 of the printer 1, a peripheral surface of a photoconductive drum 4 rotating in a direction A in FIG. 2 is uniformly charged by a charging device 3, a laser beam B in accordance with an image data is irradiated from an exposure unit 5, such as a laser scanning unit, and an electrostatic latent image is formed on the peripheral surface of the photosensitive drum 4. Then, toner particles are supplied on the electrostatic latent image formed on the peripheral surface of the photoconductive drum 4 from a developing section 6 so as to form a toner image on the peripheral surface of the photoconductive drum 4.

A sheet P is fed to the photoconductive drum 4 from a sheet supplying mechanism 10. A toner image on the peripheral surface of the photoconductive drum 4 is transferred onto the sheet P by a transferring device including a transferring roller 11. A cleaning device 13 including a cleaning roller 12 removes residual toner particles from the peripheral surface of the photoconductive drum 4. A neutralization device 14 removes residual electrical charge remaining after toner particles are removed.

A sheet P separated from the photoconductive drum 4 by a separating device 15 is fed to a fixing device including a pair of fixing rollers 16 which is adapted for fixing the toner image onto the sheet P, and then, discharged by a discharging roller 17 to a discharge section 18.

The sheet supplying mechanism 10 is detachably mounted on the housing 2, and provided with a sheet supplying cassette 19 which can accommodate a number of sheets P in a stacked state. The sheet supplying cassette 19 includes a picking-up roller 20 for picking up the accommodated sheet P and a sheet supplying roller 21 for feeding the sheet P picked up by the picking-up roller 20 to a conveyance passage one by one. A pair of registration rollers 22 for regulating the conveying of the sheet P are disposed on an upstream (a right side of the FIG. 2) of the photoconductive drum 4 in the conveyance passage.

The conveyance passage includes a first conveyance passage 26 for feeding the sheet P from the sheet supplying cassette 19 to the photoconductive drum 4, a second conveyance passage 27 for feeding the sheet P from the photoconductive drum 4 to the pair of fixing rollers 16, and a third conveyance passage (a reversing passage) 28 for feeding the sheet P from the pair of fixing rollers 16 to the pair of discharging rollers 17.

The first conveyance passage 26 is arranged in such a manner that it extends upward substantially vertically in a relatively right side of the housing 2 in FIG. 2, and curves toward a left side of the housing 2 at a middle height of the housing 2 to extend horizontally up to the photoconductive drum 4.

The third conveyance passage 28 is arranged in such a manner that it extends upward substantially vertically from the middle height of the housing 2 in a relatively left side of the housing 2, that is, opposite to the first conveyance passage 26.

The second conveyance passage 27 extends substantially horizontally from the transferring roller 11 to the fixing roller 16 in the middle height of the housing 2 in order to connect the first conveyance passage 26 to the third conveyance passage 28.

Next, description is made with respect to a sheet feeding when the printer 1 is operated.

The sheet P is picked up by the picking-up roller 20 from the sheet supplying cassette 19 of the sheet supplying mechanism 10. The picked up sheet P is fed by the sheet supplying roller 21 to the first conveyance passage 26 one by one. Then the conveying of the sheet P fed to the conveyance passage 26 is regulated in the pair of registration rollers 22.

After the toner image is formed on the peripheral surface of the photoconductive drum 4, the sheet P is released by the pair of the resist rollers 22 to the photoconductive drum 4. The toner image formed on the photoconductive drum 4 is transferred on a transferable surface of the sheet P by the transferring roller 11 disposed opposite to the photoconductive drum 4.

Then, the sheet P separated from the photoconductive drum 4 by the separating device 15 is fed to the pair of fixing rollers 16 through the second conveyance passage 27.

The toner image is fixed on the sheet P by the pair of fixing rollers 16. Then, the sheet P is discharged by the discharging roller 17 to the discharge section 18 without further processing or after being performed with both-side copying by using an unillustrated switchback section.

The housing 2 has a box-shape formed by a front wall (one wall) 2*a*, a rear wall (the other wall) 2*b*, a top wall 2*c*, a bottom wall 2*d*, and both side walls 2*e*. The rear wall 2*b* is often set on a desk 40 facing a room wall 41. With this arrangement, the sheet P can be supplied to the sheet supplying cassette 19 by pulling the sheet supplying cassette 19 out from an opening in the front wall 2*a*.

The top wall 2*c* is provided with the discharge section 18 where the sheet P is discharged. One of the side walls 2*e* is provided with an outflow opening 2*f*. The outflow opening 2*f* is provided near the pair of fixing rollers 16, and cools the pair of fixing rollers 16.

The rear wall 2*b* includes an upper portion projecting outward near the top wall 2*c* and a lower portion receding inward near the bottom wall 2*d*. The rear wall 2*b* includes an openable door 30 inclined along the rear wall 2*b* for a possible jam in the third conveyance passage.

Figure 3A:
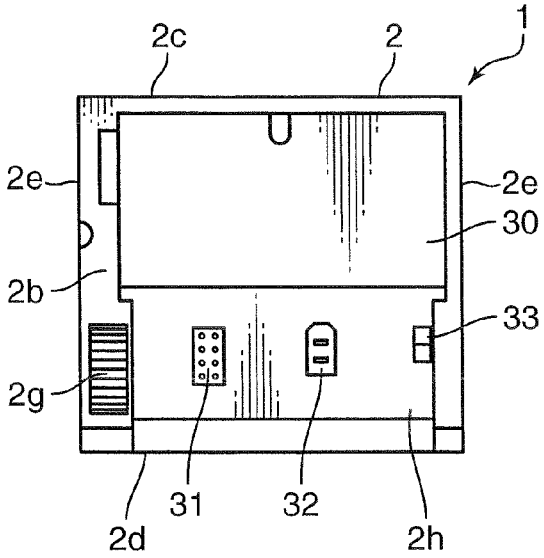

As shown in FIG. 3A, the rear wall 2*b* is provided with an outflow opening 2*g* in one side of a lower part thereof (in the left side in FIG. 3A). The outflow opening 2*g* is provided in the vicinity of a high voltage electric power supply board or a control board so as to cool these boards. The outflow opening 2*g* and the outflow opening 2*f* are connected with each other with a duct (not shown). Thus, even if the one of them is blocked off by a wall 41 of a room which the printer 1 is placed in and the like, the other one is in an outside open space.

The rear wall 2*b* includes a vertical wall 2*h*, as a part thereof, which recedes inwardly from the rear wall 2*b* and is formed in a center of the lower part or the rear wall 2*b*. The vertical wall 2*h* is provided with a cable connection port 31 for a plug of an interface cable, a cable connection port 32 for a plug of the electric power supply cable, and an electric power switch 33.

With the printer 1 configured as above, in the housing 2, the rear wall 2*b* near which the third conveyance passage 28 is provided includes the upper portion projecting outward in the top wall 2*c* and the bottom portion receding inward in the bottom wall 2*d*. Accordingly, the area of the bottom wall 2*d* is smaller than that of the top wall 2*c*, so that the space for installing the printer 1 can be reduced in the case of installing the printer 1 on the desk 40 and so on.

The third conveyance passage 28 (the reversing passage) is disposed in a space projecting outward near the top wall 2*c* in the inclined rear wall 2*b* so that the space for the third conveyance passage 28 (the reversing passage) can be assured taking advantage of an inclination of the rear wall 2*b*, thereby ensuring the conveying performance of the third conveyance passage 28 (the reversing passage).

Figure 3B:
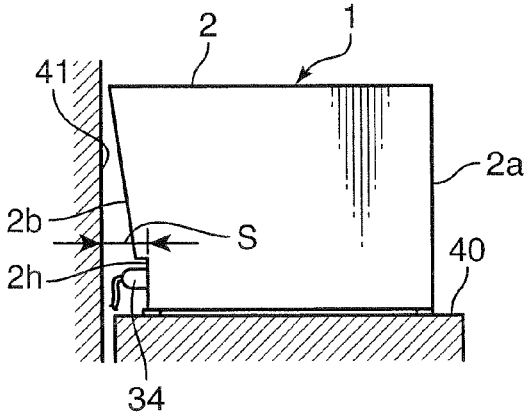
Figure 3C:
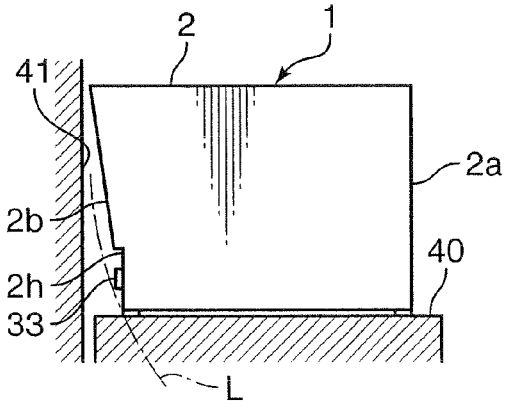

Further, the vertical wall 2*h* which is a part of the inclined rear wall 2*b* is provided with the cable connection ports 31 and 32, and the electrical power switch 33. Even if the housing 2 is so disposed that the rear wall 2*b* faces the room wall 41, the rear end of the top wall 2*c* can be disposed within a tiny distance from the room wall 41. This is because a space S for a projection 34 of a plug and a cable of the cable connecting ports 31 and 32 is assured between the vertical wall 2*h* of the inclined rear wall 2*b* and the room wall 41, as shown in FIG. 3B. Therefore, it is not necessary to dispose the printer 1 so as to provide the space for the projection 34 of the plug and the cable of the cable connecting ports 31 and 32. Accordingly, the installation space can be reduced.

Still further, in the case where the electrical power switch 33 is turned on or off by inserting an hand in an invisible gap from the front wall 2*a*, a user is not required to bow his/her body and stretch out an arm, since the inclined rear wall 2*b* is so shaped to extend along a locus L along which the arm swings. Thus, the electrical power switch 33 can be operated only by an arm.

Figure 3D:
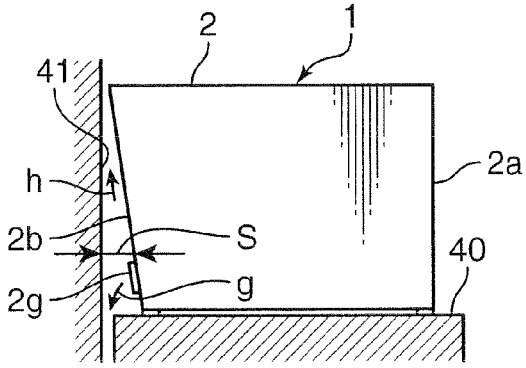

Further, the outflow opening 2*g* is formed in the inclined rear wall 2*b*. In the case where the housing 2 is so set that the rear wall 2*b* faces the room wall 41 and the rear end of the top wall 2*c* comes to a very near position to the room wall 41, because the space S is assured between the inclined rear wall 2*b* and the room wall 41, as shown in FIG. 3D, it is not necessary to dispose the printer 1 to provide a sufficient distance from the room wall 41 to keep the outflow opening 2*g* from being blocked off. Accordingly, the space for installation can be reduced.

In the case of forming an outflow opening facing a room wall directly in the conventional way, discharged air from the outflow opening is often flown upward (see an arrow h in FIG. 3D). Thus, the sheet P and the like disposed on a surface of the top wall 2*c* of the housing 2 may be blown off by the discharged air and disperses unexpectedly. However, if the outflow opening 2*g* is formed on the inclined rear wall 2*b*, the discharged air is blown downward (see an arrow g in FIG. 3D). Therefore, there is not the likelihood that the sheet P is blown off and dispersed unexpectedly by the air.

Further, in the case where the rear wall 2*b* of the housing 2 is installed without facing the room wall 41, if an outflow opening is formed in a vertical rear wall as the conventional way, the discharged air is blown out from the outflow opening in a horizontal direction to consequently hit directly the face or other portion of a person who sits close to the printer. However, the outflow opening 2*g* is formed in the inclined rear wall 2*b*. Accordingly, the discharged air (see the arrow g in FIG. 3) is blown out downward so that the discharged air will not hit directly a person who sits close to the printer.

In the foregoing embodiment, the printer 1 is raised as an example. The printer 1 is shaped into a box as a usual shape. Accordingly, the advantageous effects can be seen in compact-type or small-type printers to be placed on a desk. However, it is needless to say that the present invention may be applied to other image forming apparatuses such as a copying machine, a facsimile machine, or a composite machine.

This application is based on patent application No. 2005-46616 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus having a box-shaped housing with a top wall, a bottom wall spaced vertically below the top wall, substantially opposite first and second walls extending from the top wall towards the bottom wall and opposite side walls extending between the top and bottom walls and between the opposite first and second walls, the apparatus being operative to transfer a toner image onto a sheet from a photoconductive drum and fixed in a process of conveying the sheet in a conveyance passage extending in a direction from the first wall to the second wall of the box-shaped housing, and the sheet is reversed in a reversing passage connected to the conveyance passage near the second wall, and is discharged to a discharge section at the top wall of the housing, a sheet supplying cassette being disposed inside the box-shaped housing between the first and second walls and at a position in proximity to the bottom wall, wherein the second wall has an upper portion near the reversing passage and lower portion near the bottom wall, the upper portion of the second wall extending substantially entirely between the side walls of the housing and projecting outward relative to the lower portion and wherein an opening extends into the housing at a portion of the second wall adjacent the bottom wall of the housing so that at least portions of the opening and the sheet supplying cassette overlap in a vertical direction, and so that the opening is at least partly aligned with the sheet supplying cassette in a direction extending from the first wall to the second walls.

2. An image forming apparatus according to claim 1, wherein the reversing passage is arranged in proximity to an upper portion of the second wall.

3. An image forming apparatus according to claim 1, wherein a cable connection port and an electric power switch are provided in the second wall between the opening and the top wall and at positions aligned vertically with the opening, distances between the opening and the opposite side walls of the housing being no greater than distances between the cable connection port and the opposite side walls of the housing.

4. An image forming apparatus according to claim 1, wherein an outflow opening is formed in the second wall.

5. An image forming apparatus according to claim 1, wherein the image forming apparatus is a printer.

6. An image forming apparatus having a box-shaped housing with a top wall, a bottom wall spaced vertically from the top wall, substantially opposite front and rear walls extending from the top wall towards the bottom wall and substantially opposite first and second side walls extending between the top wall, the bottom wall, the front wall and the rear wall, a sheet supplying cassette disposed in the housing substantially adjacent the bottom wall and being accessible from the front wall for receiving sheets, the apparatus being operative to transfer a toner image from a photoconductive drum onto a sheet from the sheet supplying cassette and fixing the toner image on the sheet in a process of conveying the sheet in a conveyance passage extending in a direction from the front wall towards the rear wall of the box-shaped housing, the apparatus further having a reversing passage connected to the conveyance passage near the rear wall for delivering the sheet from the conveyance passage to a discharge section at the top wall of the housing, wherein the rear wall diverges from the front wall at farther distances from the bottom wall, a cable connection port being provided on the rear wall between the top and bottom walls and an opening extending into the housing at a portion of the rear wall between the cable connection port and the bottom wall so that the cable connection port is aligned vertically with a portion of the opening and so that distances between the cable connection port and the first and second side walls of the housing exceed distances between the opening and the respective side walls of the housing.

7. An image forming apparatus according to claim 6, further comprising an electric power switch on a portion of the rear wall in proximity to the cable connection port.

8. An image forming apparatus according to claim 6, further comprising a cable connected to the cable connection port and extending from the housing in proximity to the opening in the rear wall.

9. An image forming apparatus having a box-shaped housing with a top wall, a bottom wall spaced vertically from the top wall, substantially opposite front and rear walls extending from the top wall towards the bottom wall, and first and second side walls extending between the top and bottom walls and between the front and rear walls, a sheet supplying cassette disposed in the housing substantially adjacent the bottom wall and being accessible from the front wall for receiving sheets, the apparatus being operative to transfer a toner image from a photoconductive drum onto a sheet from the sheet supplying cassette and fixing the toner image on the sheet in a process of conveying the sheet in a conveyance passage extending in a direction from the front wall towards the rear wall of the box-shaped housing, the apparatus further having a reversing passage connected to the conveyance passage near the rear wall for delivering the sheet from the conveyance passage and a discharge section at the top wall of the housing for receiving the sheet from the reversing passage, wherein the rear wall diverges from the front wall at farther distances from the bottom wall, a cable connection port being provided on the rear wall between the top and bottom walls and spaced inwardly from the first and second side walls, and an opening extending into the housing at a portion of the rear wall between the cable connection port and the bottom wall, the opening being spaced inwardly from the first and second side walls by distances that are no greater than distances between the cable connection port and the corresponding first and second side walls so that the cable connection port is at a position on the rear wall aligned vertically with a portion of the opening.

10. An image forming apparatus having a box-shaped housing with a top wall, a bottom wall substantially opposite the top wall, substantially opposite first and second walls extending from the top wall towards the bottom wall and opposite sidewalls extending from the top wall towards the bottom wall and between the first and second walls, the apparatus being operative to transfer a toner image onto a sheet from a photoconductive drum and fixed in a process of conveying the sheet in a conveyance passage extending in a direction from the first wall to the second wall of the box-shaped housing, and the sheet is reversed in a reversing passage connected to the conveyance passage near the second wall, and a discharge section at the top wall of the housing and configured for receiving the sheet from the reversing passage, a sheet supplying cassette being disposed inside the box-shaped housing between the first and second walls and at a position in proximity to the bottom wall, wherein the second wall, near which the reversing passage is provided, has an upper portion projecting outward across a major portion of the second wall extending between the opposite side walls and a lower portion receding inward across a major portion of the second wall between the opposite side walls, and wherein an opening extends into the housing at a portion of the second wall adjacent the bottom wall of the housing, the opening being spaced inwardly from the side walls and being disposed at a position so that a vertical distance from a highest point of the top wall to the opening exceeds all vertical distances from the highest point of the top wall to a lowermost point of the conveyance passage.

* * * * *